US008196513B1

(12) United States Patent
O'Rourke

(10) Patent No.: US 8,196,513 B1
(45) Date of Patent: Jun. 12, 2012

(54) STAND-OFF DISRUPTER APPARATUS

(75) Inventor: Jack O'Rourke, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 368 days.

(21) Appl. No.: 12/653,414

(22) Filed: Dec. 4, 2009

(51) Int. Cl.
*F42B 30/04* (2006.01)

(52) U.S. Cl. ..... 102/483; 102/475

(58) Field of Classification Search ..... 102/475–477, 102/480, 482–484, 488, 489, 492, 494, 500, 102/501, 485, 448, 473, 438
See application file for complete search history.

(56) References Cited

U.S. PATENT DOCUMENTS 1,058,563 A * 4/1913 Deubler ..... 102/483
2,412,967 A * 12/1946 Church et al. ..... 102/475
2,415,803 A * 2/1947 Abell ..... 102/204
2,968,870 A * 1/1961 Brandt ..... 42/148
3,156,187 A * 11/1964 Baton ..... 102/483
3,245,350 A * 4/1966 Kelly ..... 89/1.808
3,479,956 A * 11/1969 Birkigt ..... 102/483
3,882,780 A * 5/1975 Gawlick et al. ..... 102/483
5,129,325 A * 7/1992 Matzagg ..... 102/445
5,594,197 A * 1/1997 Lindstadt et al. ..... 102/499

* cited by examiner

*Primary Examiner* — Bret Hayes
*Assistant Examiner* — Reginald Tillman, Jr.
(74) *Attorney, Agent, or Firm* — James T. Shepherd

(57) ABSTRACT

The invention in one variation is a stand-off disrupter apparatus that includes a delivery vessel having an enlarged rounded front end with an apex and an elongate cylindrical section that in part serves to fit the apparatus onto the barrel of a shotgun. The shotgun provides propulsion. The apparatus has fins, a sighting system, a firing pin system that fires on impact, a shell loaded with shot housed in a shell chamber, and a layer of disruption medium sealed in a dish forward of the shell and set-back from the apex. The disruption medium is energized on impact by the shot from the shell and a force of the impact. The energized disruption medium can neutralize an improvised explosive device.

20 Claims, 4 Drawing Sheets

STAND-OFF DISRUPTER APPARATUS

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

1. Field of the Invention

The present invention relates generally to equipment for neutralizing, and in particular to a stand-off disrupter apparatus for neutralizing improvised explosive devices.

2. Prior Art

Properly trained and equipped Explosive Ordnance Disposal (EOD) technicians provide the best resource for responding to and neutralizing potential improvised explosive device (IED) threats. Under certain circumstances the availability of EOD forces is extremely limited. Under these conditions the options available to operational commanders, without EOD support, are limited to either 1) mark and bypass the threat, 2) disrupt with direct fire from a safe distance, or 3) cordon off the area and wait for EOD support. Marking and bypassing the threat (due to urgent operational commitments) leaves the threat for follow-on use or a hazard to others. The use of standard issue weapons to effect direct fire disruption to neutralize improvised explosive device increases the probability of a high order detonation and increases the risk of a severe down range collateral hazard. Finally, establishing a security cordon and waiting for EOD support leaves a static target that potentially is an enemy opportunity target, for instance, by direct action, ambush, indirect fire, and the like.

An additional capability for commanders faced with the unavailability of EOD support to neutralize improvised explosive devices would be useful.

SUMMARY OF THE INVENTION

The invention provides for an apparatus for neutralizing improvised explosive devices, where an improvised explosive device includes car bombs, truck bombs, mines, suicide bombers with attached or detached explosives, caches of munitions, and the like. The apparatus provides a stand-off disrupter which facilitates safer separation while neutralizing the improvised explosive devices. Hand held firearms used to disrupt or neutralize improvised explosive devices are inefficient because at a safe distance a bullet impacts only a relatively small area, a shotgun shell shot has a scatter pattern that is too dispersed at safe distances, and a more effective tactic is to attack using a medium that neutralizes the timing power unit or another electrical component of the detonator.

The invented stand-off disrupter apparatus includes a delivery vessel with an adaptation for an extrinsic propulsion system, where the delivery vessel has an elongate cylindrical portion and an enlarged rounded front end with an apex. The enlarged rounded front end can be substantially ellipsoidal. A rearward sub-portion of the delivery vessel has an axial shroud which provides the adaptation suitable as the extrinsic propulsion system. The apparatus typically includes aerodynamic components that stabilize flight. The delivery vessel may also have a sighting system for aiming the apparatus. The delivery vessel, in one variation, houses a shotgun shell, which is mounted rearward and substantially coextensive with a substantially frustoconical bore that opens outward toward the enlarged rounded front end. The frustoconical bore provides a channeled pressure focal cone for the contents of the shell. The elongate cylindrical section of the delivery vessel houses a firing pin system rearward of the shotgun shell. The firing pin system detonates the shotgun shell when the apparatus impacts a surface. A layer of disruption medium, sealed in a dish, is proximate to a forward end of the bore, and set-back from the apex. The disruption medium is energized by the impact and shot emitted from the shell upon detonation. The energized disruption medium suitably neutralizes improvised explosive devices typically by disrupting the detonation component of the IED, albeit sympathetic explosions can also be effected.

The disruption medium is typically composed of water, water-based materials or water-based slurries. The invention provides improved frontal and overhead protection against blast and fragmentation in the event of a high order detonation, and the apparatus itself does not generate lethal fragments.

The stand-off disrupter apparatus provides separation. The separation is not to be confused with the "safe separation distance", which is outside the blast or fragmentation range. Examples of extrinsic propulsion systems include cranes, planes, helicopters, drones, helicopters, robotic devices, firearms and rockets.

An aspect of the invention is that the stand-off disrupter apparatus can be fitted onto a barrel of a firearm, such as a shotgun, where the firearm serves as the extrinsic propulsion system. The extrinsic propulsion system is actuated when the firearm is discharged, emitting a projectile. The extrinsic propulsion system propels the stand-off disrupter apparatus. The axial shroud typically includes a bullet trap to catch the projectile(s). An example of a suitable projectile is pellets or shot. The firearm and ammunition are selected to match the characteristics of the stand-off disrupter apparatus. An example of a suitable hand carried firearm is a 12 gauge shotgun, and suitable ammunition is a shotgun shell loaded with buckshot (i.e. 000 shot).

BRIEF DESCRIPTION OF THE DRAWINGS

The foregoing invention will become readily apparent by referring to the following detailed description and the appended drawings in which.

DETAILED DESCRIPTION OF THE INVENTION

The invention provides for an apparatus 10 for neutralizing improvised explosive devices, where an improvised explosive device includes car bombs, truck bombs, mines, suicide bombers with attached or detached explosives, caches of munitions, and the like. The apparatus 10 provides a stand-off disrupter which facilitates safer separation while neutralizing improvised explosive devices.

The apparatus produces an energized disruption medium upon impact, which neutralizes improvised explosive devices.

Figure 1:
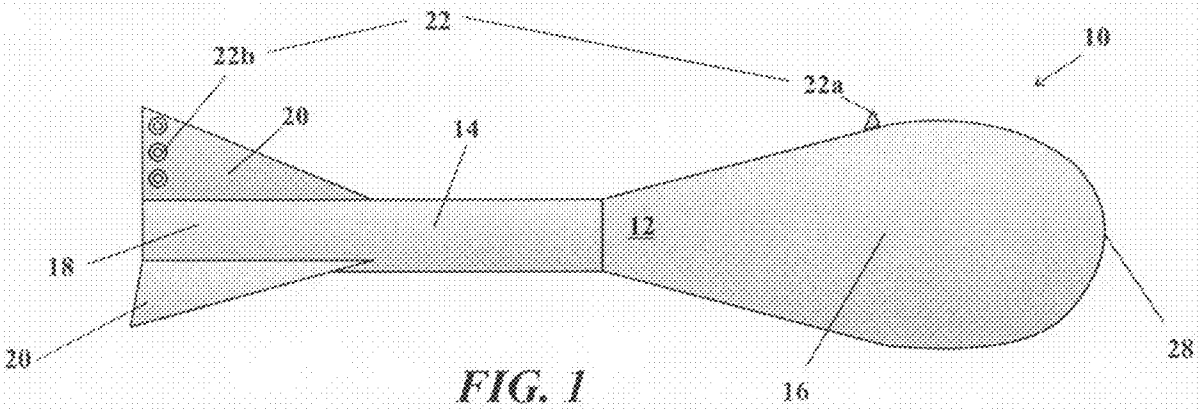
FIG. 1 is a side view of a version of the stand-off disrupter apparatus illustrating aspects of the delivery vessel, including an elongate cylindrical portion, an ellipsoidal front end, an axial shroud on the rear end, aerodynamic fins, and a sighting system for aiming the apparatus.

Referring to FIG. 1, the stand-off disrupter apparatus has an adaptation for an extrinsic propulsion system, where the apparatus 10 includes a delivery vessel which houses the disruption medium and some of the elements for energizing the disruption medium at impact. The extrinsic propulsion system is defined as a system where the energy to move the apparatus to the target is provided by an external propulsion system. For instance, a trailer is propelled by a tractor pulling the trailer. The tractor is the external propulsion system. Alternatively described, the tractor is an example of an intrinsic propulsion system, as the tractor can propel itself, and it has an internal propulsion system.

The delivery vessel 12 includes an elongate cylindrical section 14, an enlarged rounded front end 16 that is substantially ellipsoidal in shape, an axial shroud 18 continuous with the rear end, and aerodynamic fins 20 that stabilize flight.

In the illustrated example there are three fins, but there could be more or less, and the fins can be trimmed to induce rotation. Also illustrated is a sighting system 22 for aiming the apparatus. The illustrated system has a "blade" type front sight 22*a*, and an aperture style rear sight 22*b*, such as a "Ghost Ring", "notch", "V" sight and the like. Other sighting systems, such as laser sights and optical sights may be employed.

Figure 2:
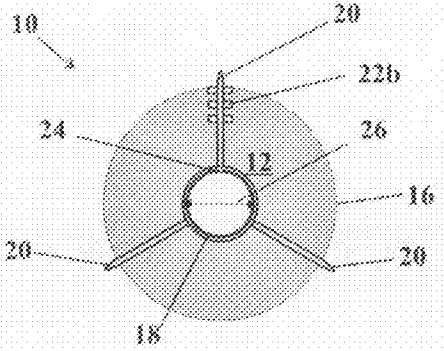
FIG. 2 is a rear end view of the stand-off disrupter apparatus illustrated in'FIG. 1.

Referring to FIG. 2, which is an end-on rear view of the stand-off disrupter apparatus illustrated in FIG. 1, the elongate cylindrical section 14 and the enlarged rounded ellipsoidal front end 16 are coaxial and symmetrical. The fins 20 extend from the elongate cylindrical section 14. The center of the elongate cylindrical section 14 is hollow, such that a portion of the elongate cylindrical section 14 forms the axial shroud 18, which is the adaptation for fitting to the extrinsic propulsion system. The illustrated shroud has a small groove 24 cut axially down the top of the axial shroud 18 to receive the front sight 32 (see FIG. 5) on the barrel of a shotgun. The axial shroud 18 has a diameter 26 that is sized so that it can readily accommodate the barrel of the shotgun. In one example, the shotgun is 12 gauge having a single barrel. In another example the shotgun is 10 gauge. A 12-gauge shotgun nominally has an inside diameter of 18.5 mm (0.729 inches). That diameter can range from a tight 18.3 mm to an extreme overbore of 20.3 mm, so the inside diameter 26 of the axial shroud 18 is properly sized for the outside diameter of the gun barrel before fitting the stand-off disrupter apparatus onto the gun. In this embodiment the rear sight 22*b* is illustrated as being substantially integral to the top fin.

Figure 3:
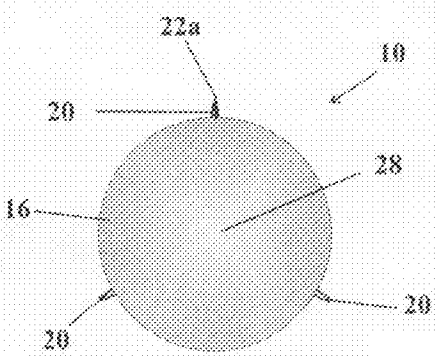
FIG. 3 is a front end view of the stand-off disrupter apparatus illustrated in FIG. 1.

Referring to FIG. 3, which is an end-on front view of the stand-off disrupter apparatus illustrated in FIG. 1, the apex 28 of ellipsoidal front end 16 is approximately the cross-sectional center of the ellipsoidal front end 16. The front sight 22*a* is shown superimposed in front of the top fin. Other embodiments are anticipated to be a variation of the disclosed instant invention.

Figures 4, 5:
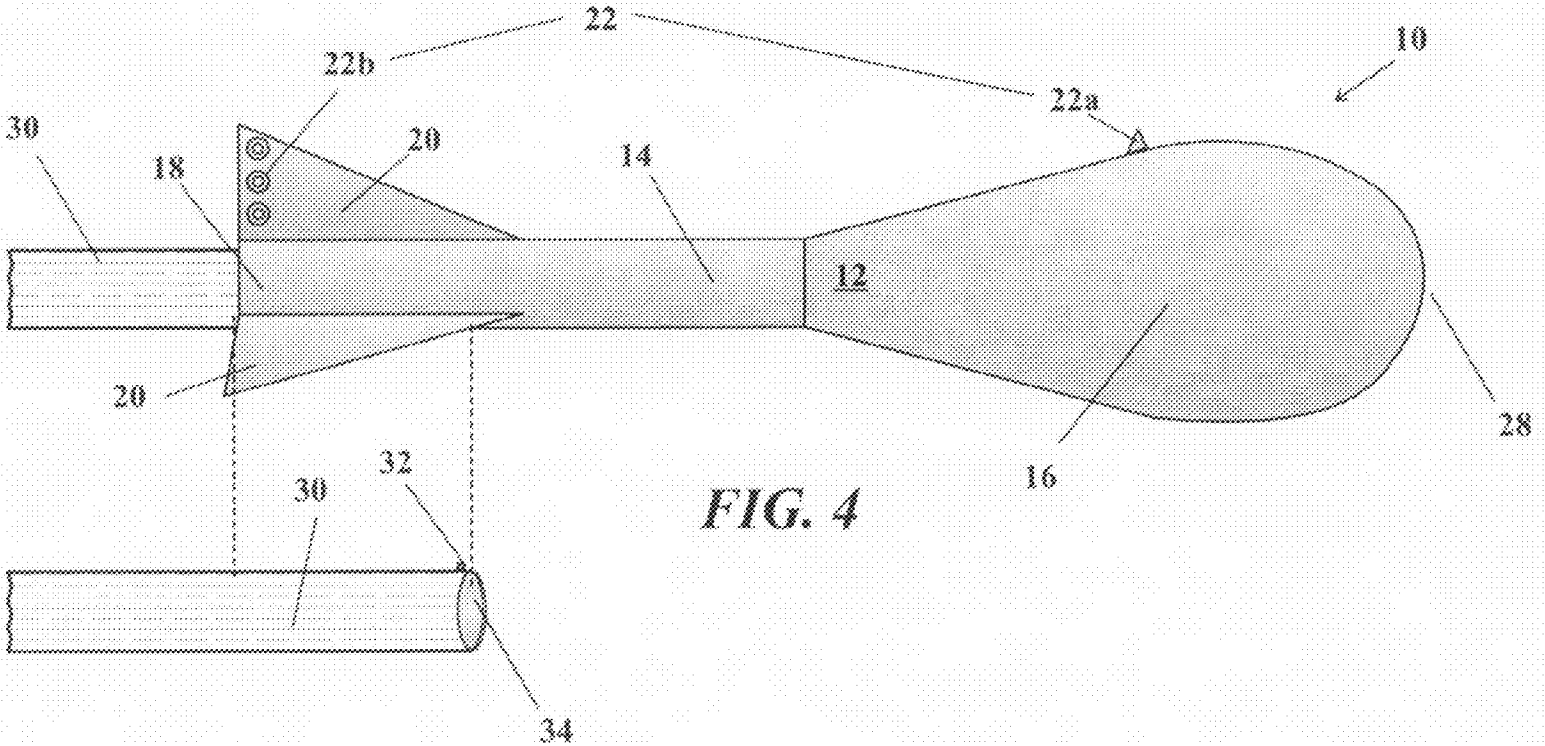
FIG. 4 is a side view of a ready to fire stand-off disrupter apparatus, where the axial shroud is fitted onto a shotgun barrel.
FIG. 5 is a side view of the shotgun barrel illustrated in FIG. 4.

FIG. 4 shows a side view of the stand-off disrupter apparatus that is ready to fire, where the axial shroud 18 is fitted onto a shotgun barrel 30. The fit is loose enough that the shotgun barrel does not explode when the gun is discharged. The single barrel shotgun is loaded with a second shotgun shell.

Figure 6:
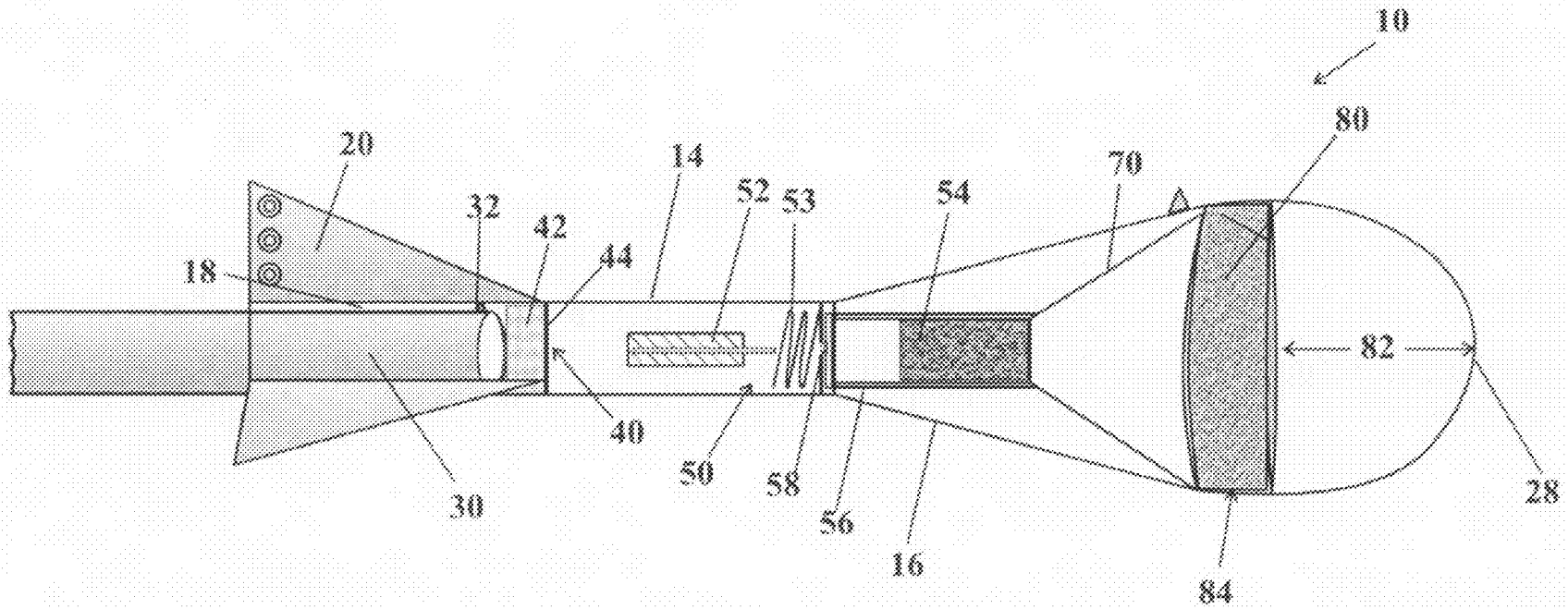
FIG. 6 is a cutaway side view of the stand-off disrupter apparatus illustrated in FIG. 1.

FIG. 5 shows a side view of the shotgun barrel 30. As can readily be seen in FIGS. 4 and 5, the axial shroud 18 accounts for about half the length of the elongate cylindrical section 14. Referring to FIG. 4, FIG. 5 and FIG. 6 together, the barrel 30 is coaxial with the elongate cylindrical section 14, and from viewing FIG. 6, the reader can see that it fits approximately half way into the elongate cylindrical section 14.

Figure 7:
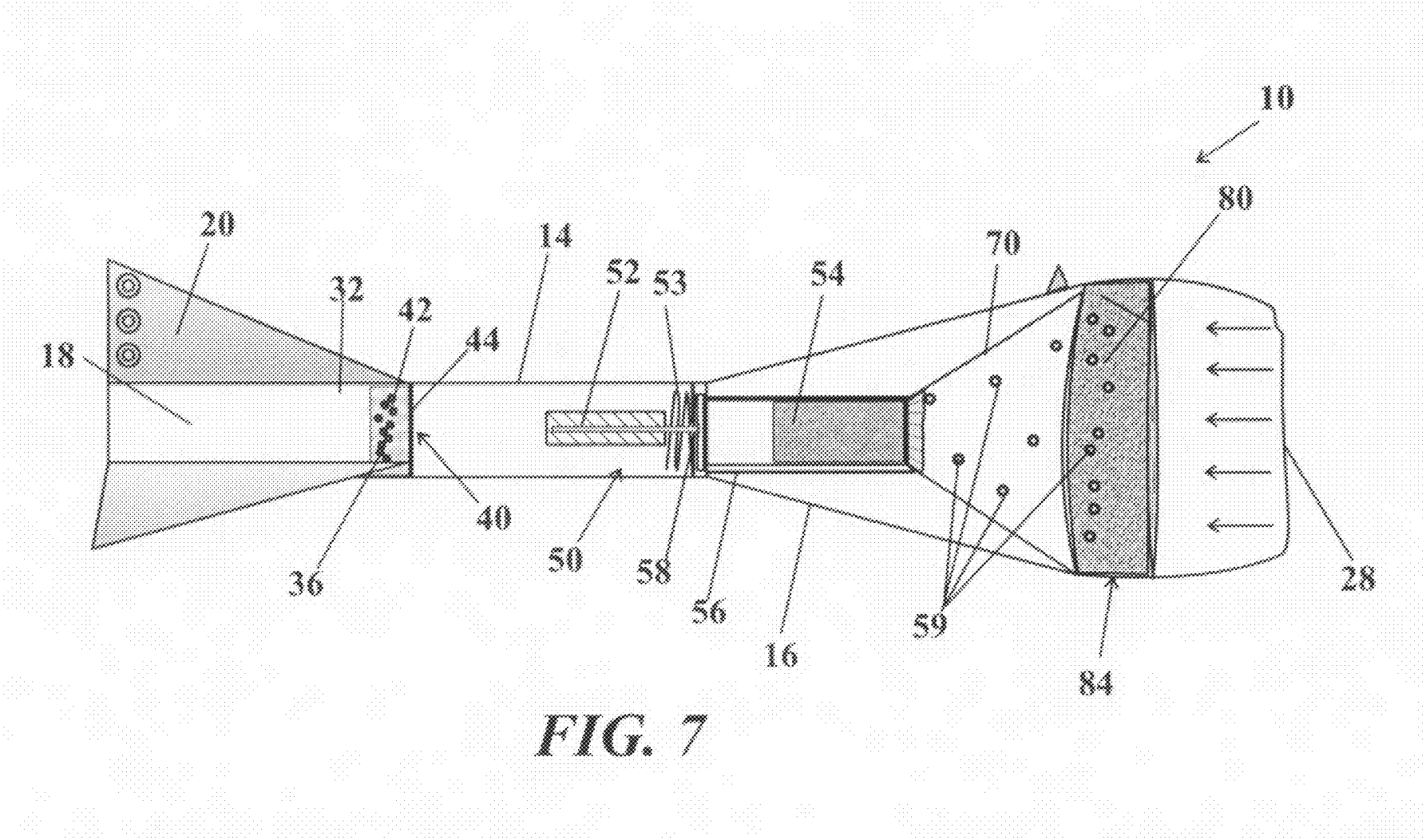
FIG. 7 is a cutaway side view of the stand-off disrupter apparatus illustrated in FIG. 6 (at the instant of impact), where the firing pin has detonated the housed shotgun shell, causing the shot to be blown through the frustoconical bore into the layer of disruption medium, which is set-back from the apex.

Referring to FIGS. 6 and 7, which are cutaway side views of the stand-off disrupter apparatus, the muzzle of the shotgun barrel 30 is adjacent to an internal bullet trap 40 in the axial shroud 18. In the illustrated embodiment the bullet trap 40 is typically at least one layer of a resilient rubber 42 laminated to a metal (i.e. steel) plate 44. Other combinations of materials are also anticipated. The internal bullet trap 40 traps most of the gun shot 36 discharged from the shotgun barrel 32. The momentum of the gun shot 36 and the energy of the gasses discharged from the shotgun serve to provide the stand-off disrupter apparatus 10 with an extrinsic propulsion system, capable of propelling the invention tens to hundreds of meters to the target. Forward of the bullet trap 40 is a firing pin system 50 which is actuated when the apparatus impacts a surface. As illustrated, a spring 53 restrains the firing pin 52. Forward of the firing pin system 50 is a shotgun shell 54 secured in shell chamber 56. When the apparatus 10 impacts a surface, such as an IED structure, the momentum of the firing pin 52 overcomes the restraining force of spring 53 and firing pin 52 strikes the percussion cap 58 initiating the primer, which in turn causes the shell 54 to fire. Shot 59 emerges from the cartridge in a spread pattern. The spreading can be augmented by selecting a shell with spreader wads. The illustrated embodiment includes a substantially frustoconical bore 70 that opens outward in the substantially ellipsoidal front end 16. The frustoconical bore provides a channeled pressure focal cone for the contents the shot 59) of the shell. A layer of disruption medium 80, sealed in a dish 84, is proximate to a forward end of the bore 70, and set-back 82 from the apex 28 of the ellipsoidal front end 16. The disruption medium 80 will be highly energized by the shot 59 emitted from the shell.

The disruption medium 80 is selected from the group consisting of water, water based materials, and water based slurries. The disruption medium 80 can contain abrasives, which serve to abrade away protective surfaces on wires, explosives, batteries, and electrical components, such as timers. In the illustrated embodiment the layer of disruption medium 80 is set-back 82 from the apex 28 of ellipsoidal front end 16. The set-back causes some of the force of impact to be transmitted to the disruption medium 80, therein elevating the level of energization of the disruption medium 80 (i.e. higher temperature, change of state to a gas), so that it essentially explodes on impact.

As illustrated in FIG. 7, which is a cutaway side view of the stand-off disrupter apparatus 10 illustrated in FIG. 6 at the instant of impact, the firing pin 52 has detonated the chambered shotgun shell 54, causing the shot 59 from the shell to be blown through the expanded bore 70 into the layer of disruption medium 80. The ellipsoidal front end 16 is being crushed, transmitting some of the force of impact unto the disruption medium 80, as illustrated by the arrows. In this idealized depiction the disruption medium 80, which is sealed in a dish 84, has not broken apart. FIG. 7 is meant only to show some of the steps at impact. In reality, at impact the disruption medium 80 may have already smashed into the enlarged rounded ellipsoidal front end 16, and the shot could be scattered throughout. The dish 84 is typically not designed to withstand impact, and the disruption medium 80 will not stop all the shot 59.

In one variation the stand-off disrupter apparatus utilizes a 12 gauge shell. Other larger shells, for example 2-10 gauge shells, and smaller shells can be employed, as well as shaped charges in general. The stand-off disrupter apparatus would be appropriately sized to sufficiently energize the disruption medium. The extrinsic propulsion system can be selected from a variety of propulsion systems, including shotguns, such as 12 gauge shotgun, and less common guns, such as 2-20 gauge guns. The total level of energization of the disruption medium 80 is a function of both the extrinsic propulsion system and the shell carried by the stand-off disrupter apparatus. A 12 gauge shotgun can potentially accurately deploy the apparatus approximately about 50 ft (~15 meters) to about 300 ft (~100 meters).

The apparatus can be used in combination with other devices, such as thermite and nanothermite based devices, which are employed to remove protective coverings without igniting an enclosed explosive.

Advantages of the disclosed invention include the following: It is light weight; it provides operational commanders with an effective disruption capability; it enables a safer stand-off distance for better frontal and overhead protection; its design utilizes standard issue ammunition, materials, and equipment to minimize cost and logistic support requirements; there is less collateral (down range or direct area) damage and fragmentation hazard (notwithstanding the effects of a possible sympathetic detonation); when unloaded it poses no storage or explosive hazard in high electromagnetic environments; and it poses no electromagnetic hazard.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

It is to be understood that the foregoing description and specific embodiments are merely illustrative of the best mode of the invention and the principles thereof, and that various modifications and additions may be made to the invention by those skilled in the art, without departing from the spirit and scope of this invention, which is therefore understood to be limited only by the scope of the appended claims.

What is claimed is:

1. A stand-off disrupter apparatus, said apparatus comprising:

a delivery vessel with an adaptation for an extrinsic propulsion system, said delivery vessel having an enlarged rounded front end with an apex and an elongate cylindrical section with a rearward portion that is an axial shroud having a bullet trap and serving as the adaptation for the extrinsic propulsion system, and an aerodynamic component to stabilize flight;

a firing pin system that fires on impact;

a shotgun shell loaded with shot housed in a shell chamber;

a substantially expanding bore adjacent to the shell, where said bore opens outward in the enlarged rounded front end, providing a channeled pressure focal cone for the shot; and a layer of disruption medium sealed in a dish proximate to the forward end of the bore and set-back from the apex;

where the disruption medium is energized on impact by the shot from the fired shotgun shell and a force of the impact;

wherein said energized disruption medium can neutralize an improvised explosive device.

2. The apparatus according to claim 1 further comprising a sighting system for aiming the apparatus.

3. The apparatus according to claim 1, wherein said disruption medium is selected from the group consisting of water, water-based materials or water-based slurries.

4. The apparatus according to claim 1, wherein said extrinsic propulsion system is selected from the group consisting of cranes, planes, helicopters, drones, helicopters, robotic devices, firearms and rockets.

5. The apparatus according to claim 1, wherein said extrinsic propulsion system is a shotgun firing a, shotgun shell.

6. The apparatus according to claim 1, wherein said aerodynamic component comprises two or more fins.

7. The apparatus according to claim 1, wherein said bullet trap comprises at least one resilient rubber layer laminated to a metal plate.

8. The apparatus according to claim 1, wherein said axial shroud is hollow with a small groove cut axially down the top to receive a front sight on a barrel of a shotgun.

9. The apparatus according to claim 8, wherein said axial shroud has a diameter that is sized so that it can readily accommodate the barrel of the shotgun.

10. A stand-off disrupter apparatus that is ready to be fired, said apparatus comprising:

a shotgun having a single barrel and a second shotgun shell;

a delivery vessel with an adaptation for an extrinsic propulsion system, said delivery vessel having an enlarged rounded front end with an apex and an elongate cylindrical section with a rearward portion that is an axial shroud having a bullet trap and serving as the adaptation for the extrinsic propulsion system, and an aerodynamic component to stabilize flight;

a firing pin system that fires on impact;

a first shotgun shell loaded with shot housed in a shell chamber;

a substantially expanding bore adjacent to the first shotgun shell, where said bore opens outward in the enlarged rounded front end, providing a channeled pressure focal cone for the shot; and a layer of disruption medium sealed in a dish proximate to the forward end of the bore and set-back from the apex;

where the axial shroud is loaded onto the single barrel of the shotgun;

where the apparatus will be propelled by a force from the second shotgun shell;

where the disruption medium is energized on impact by the shot from the fired first shotgun shell and a force of impact, said force of impact being derived from the second shotgun shell;

wherein said energized disruption medium can neutralize an improvised explosive device.

11. The apparatus according to claim 10 further comprising a sighting system for aiming the apparatus.

12. The apparatus according to claim 10, wherein said first shotgun shell is a 12 gauge shell.

13. The apparatus according to claim 10, wherein said second shotgun shell is a 12 gauge shell.

14. The apparatus according to claim 10, wherein said disruption medium is selected from the group consisting of water, water-based materials or water-based slurries.

15. The apparatus according to claim 12 wherein said aerodynamic component comprises two or more fins.

16. The apparatus according to claim 10, wherein said bullet trap comprises at least one resilient rubber layer laminated to a metal plate.

17. The apparatus according to claim 10, wherein said barrel fits approximately half way into the elongate cylindrical section.

18. A stand-off disrupter apparatus for neutralizing explosive devices, said apparatus comprising:

an elongate, hollow cylindrical section having an inside diameter sized to receive the barrel of a shotgun inserted therein at its rear end;

an enlarged, hollow, ellipsoidal front end coupled coaxially to the front end of said cylindrical section, said ellipsoidal front end having an apex at its forward end;

a bullet trap disposed in the interior of said cylindrical section;

a shotgun shell loaded with shot disposed forward of said bullet trap proximally to the interface between said cylindrical section and said ellipsoidal front end;

a firing pin system disposed between said bullet trap and said shotgun shell, said firing pin system comprising a firing pin disposed proximally to said shotgun shell and a spring restraining said firing pin from striking said shotgun shell;

a sealed dish disposed inside said ellipsoidal front end at a set-back distance from said apex;

a disruption medium contained within said sealed dish; and a frustoconical bore disposed between said shotgun shell and said sealed dish, said frustonical bore opening outward from said shotgun shell towards said sealed dish;

wherein said spring is selected to allow said firing pin to strike the percussion cap in said shotgun shell when forward momentum is imparted to said firing pin due to impact of the standoff disruptor apparatus against a target.

19. The apparatus according to claim 18 further comprising:

a sighting system disposed on the exterior of the apparatus for aiming; and at least one stabilizing fin disposed on the exterior of the apparatus.

20. The apparatus according to claim 18 wherein said disruption medium is selected from the group consisting of water, water-based materials or water-based slurries.

* * * * *